US006530421B1

(12) United States Patent
Filius et al.

(10) Patent No.: US 6,530,421 B1
(45) **Date of Patent: *Mar. 11, 2003**

(54) COUNTERFLOW EVAPORATOR FOR REFRIGERANTS

(75) Inventors: Ronald Henry Filius, York, PA (US); Stephen Harold Smith, York, PA (US)

(73) Assignee: York International Corporation, York, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/540,282

(22) Filed: Mar. 31, 2000

Related U.S. Application Data

(63) Continuation of application No. 08/991,622, filed on Dec. 16, 1997, now Pat. No. 6,092,589.

(51) Int. Cl.[7] ..... F28F 13/12

(52) U.S. Cl. ..... 165/109.1; 165/159; 165/174; 165/181

(58) Field of Search ..... 165/109.1, 174, 165/159, 160, 181

(56) References Cited

U.S. PATENT DOCUMENTS

| | | | | |
|---|---|---|---|---|
| 609,499 | A | | 8/1898 | Chatwood et al. |
| 665,912 | A | | 1/1901 | Jolicard |
| 1,303,107 | A | | 5/1919 | Oderman |
| 1,410,561 | A | | 3/1922 | Foreseille |
| 1,454,053 | A | | 5/1923 | Jones |
| 1,930,782 | A | | 10/1933 | Turner |
| 2,318,206 | A | | 5/1943 | Eisenlohr |
| 2,726,681 | A | | 12/1955 | Gaddis et al. |
| 2,905,447 | A | * | 9/1959 | Huet ..... 165/174 |
| 3,036,818 | A | | 5/1962 | Legrand |
| 3,232,341 | A | | 2/1966 | Woodworth |
| 3,332,468 | A | | 7/1967 | Dietze et al. |
| 3,339,631 | A | | 9/1967 | McGurty et al. |
| 3,477,412 | A | | 11/1969 | Kitrilakis |
| 3,749,155 | A | | 7/1973 | Buffiere |
| 3,983,861 | A | | 10/1976 | Beauchaine |
| 4,090,559 | A | | 5/1978 | Mergerlin ..... 138/38 X |
| 4,111,402 | A | | 9/1978 | Barbini |
| 4,154,296 | A | | 5/1979 | Fijas |
| 4,280,535 | A | | 7/1981 | Willis |
| 4,412,582 | A | | 11/1983 | Mecozzi et al. |
| 4,425,942 | A | | 1/1984 | Hage et al. |
| 4,705,106 | A | | 11/1987 | Hornack et al. |
| 4,771,824 | A | | 9/1988 | Rojey et al. |
| 4,784,218 | A | | 11/1988 | Holl ..... 165/109.1 |
| 4,834,173 | A | | 5/1989 | Weiss et al. |
| 5,167,275 | A | | 12/1992 | Stokes et al. |
| 5,219,374 | A | | 6/1993 | Keyes |
| 5,341,769 | A | * | 8/1994 | Ueno et al. ..... 165/176 X |
| 5,454,429 | A | | 10/1995 | Neurauter |

FOREIGN PATENT DOCUMENTS

| | | | | |
|---|---|---|---|---|
| CH | 665273 | * | 4/1988 | ..... 165/174 |
| DE | 3045731 | * | 7/1982 | ..... 165/174 |
| FR | 1249001 | * | 11/1960 | ..... 165/174 |
| GB | 2069676 | | 2/1980 | |

* cited by examiner

*Primary Examiner*—Leonard Leo
(74) *Attorney, Agent, or Firm*—Finnegan, Henderson, Farabow, Garrett & Dunner, LLP

(57) ABSTRACT

A counterflow evaporator for refrigerants, in particular for zeotropic refrigerants, where elongated inner members are inserted in the elongated tubular members of the evaporator to form an annular passage through which the refrigerant can flow. Resilient support members maintain the elongated inner members in position within the elongated tubular members.

64 Claims, 6 Drawing Sheets

COUNTERFLOW EVAPORATOR FOR REFRIGERANTS

This is a continuation of application Ser. No. 08/991,622, filed Dec. 16, 1997 now U.S. Pat No. 6,092,589, where is incorporated herein by reference.

BACKGROUND OF THE INVENTION

1. Field of the Invention

The present invention relates to heat exchanger evaporators, especially to a counterflow evaporator optimized for zeotropic refrigerants having significant glide characteristics. In particular, the invention relates to a shell and tube type evaporator, where the refrigerant flows through the tubes and evaporates, while a fluid flows through the shell and is cooled by the evaporating refrigerant. The evaporator is a component of a refrigeration system which can be used for cooling large quantities of water.

2. Description of Related Art

Refrigeration systems of the type used to cool large quantities of water typically include a heat exchanger evaporator having two separated passageways. One passageway carries refrigerant, and another carries the fluid to be cooled, usually water. As the refrigerant travels through the evaporator, it absorbs heat from the fluid and changes from a liquid to a vapor phase. After exiting the evaporator, the refrigerant proceeds to a compressor, then a condenser, then an expansion valve, and back to the evaporator, repeating the refrigeration cycle. The fluid to be cooled passes through the evaporator in a separate fluid channel and is cooled by the evaporation of the refrigerant. The fluid can then be routed to a cooling system for cooling the spaces to be conditioned, or it can be used for other refrigeration purposes.

One method of increasing the efficiency of heat exchanger evaporators in general, especially those of shell and tube type, is to vary the number and the dimensions of the tubes carrying the refrigerant. This approach, however, results in a prohibitive cost increase.

Another approach used to increase the efficiency of heat exchangers in general has been to install rods in heat exchanger tubes, to form annular passages within which a fluid flows. Applications of this approach are disclosed in U.S. Pat. No. 1,303,107 to Oderman; U.S. Pat. No. 3,749,155 to Buffiere; and U.S. Pat. No. 5,454,429 to Neusauter. This approach increases heat transfer through the outer wall of the annulus by increasing refrigerant flow rate near the wall. However, this approach often has drawbacks. For example, galvanic corrosion between metal parts made of different metals can cause premature failures of the heat exchanger and require excessive maintenance and repairs. When the rods are used within the tube passages, the energy of the flow can cause the rods to vibrate. The acoustic energy developed by the interaction between the flow and the rods in the tubes can damage the structure of the evaporator over time. In some application, this approach causes a high pressure drop across the tube, thereby reducing the efficiency of the refrigeration cycle. Moreover, applications of this approach often have increased the costs of the resultant heat exchanger substantially, because of the material costs of the rod and the material and labor costs associated with installing and holding the rod within the tube.

Recently, certain regulatory bodies have placed restrictions on the types of refrigerants that can be used in certain refrigeration applications. In view of these restrictions, along with the above limitations on existing evaporator designs, there continues to exist a need for an improved evaporator for refrigerants.

SUMMARY OF THE INVENTION

Accordingly, an object of the present invention is to provide an evaporator for a refrigeration cycle that addresses the problems, limitations, and disadvantages of presently used evaporators of all types, particularly those used in air cooled chiller units.

Another object is to provide an evaporator that efficiently operates with newer refrigerants, particularly zeotropic refrigerants with glide characteristics.

Yet another object is to provide an improved evaporator that is made of inexpensive components and is economical to build.

Additional features and advantages of the invention will be set forth in the description which follows, and in part will be apparent from the description, or may be learned by practice of the invention. The objectives and other advantages of the invention will be realized and obtained by the apparatus and combinations particularly pointed out in the written description and claims hereof, as well as the appended drawings.

To achieve these and other advantages and in accordance with the purpose of the invention as embodied and broadly described, the invention includes a heat exchanger assembly comprising a tubular elongated member, an elongated inner member disposed within the elongated tubular member, both members being dimensioned to form an annulus between the opposing surfaces of the inner and tubular members. This annulus facilitates heat transfer between a refrigerant flowing in the annulus and a fluid flowing over the tubular member. The assembly also includes a plurality of resilient support members, spaced along the length of the inner member and protruding from the inner member, to engage the tubular member and support the inner member concentrically within the tubular member. The support members preferably are tufts, most preferably tufts that are made of clusters of bristles fabricated integrally with the inner member.

Preferably, a plurality of the heat exchanger tube assemblies are held within a shell of an evaporator, with each assembly having a length determined according to the amount of heat being exchanged. The resultant evaporator preferably is used to transfer heat between a zeotropic refrigerant and water, in a air cooled chiller application. In that embodiment, the refrigerant is flowed through the evaporator in a single pass in one direction, while the water is flowed through the evaporator in a single pass in the opposite direction. The inner member preferably is shaped as an elongated cylinder.

In another aspect, the invention includes a method for exchanging heat between a fluid and a refrigerant in a tube(s) and shell heat exchanger, comprising the steps of flowing the refrigerant through an annular passage formed between the opposing surfaces of an elongated tubular member and an elongated inner member contained within the tubular member, where the tubular member is in turn contained within an elongated chamber. The inner member is supported within the tubular member by a plurality of resilient supports which are spaced along the length of the inner member and protrude from the inner member to engage the tubular member. The method also comprises the step of flowing the fluid in the elongated chamber around the outer surface of the tubular member, to effectuate a heat exchange with the refrigerant. Preferably, the refrigerant is a zeotropic refrigerant having significant glide characteristics. The refrigerant and the fluid flow in opposite directions through the heat exchanger, each making only a single pass.

Experimentation has also shown improvements using this invention with evaporators employing a single constituent refrigerant, such as R-22.

It is to be understood that both the foregoing general description and the following detailed description are exemplary and explanatory only.

The accompanying drawings are included to provide a further understanding of the invention and are incorporated in and constitute a part of the specification, illustrate several embodiments of the invention, and together with the description serve to explain the principles of the invention.

DETAILED DESCRIPTION

Reference will now be made in detail to the present preferred embodiments of the invention, examples of which are described in the accompanying specification and/or illustrated in the accompanying drawings.

While the present invention has broader application regarding a heat exchanger assembly for transferring heat between fluids flowing in and fluids flowing over a tubular member, the invention was developed and has particular application as an evaporator assembly in an HVAC air cooled chiller system, preferably one that uses zeotropic refrigerants. Zeotropic refrigerants are composed of multiple constituents, each constituent having a different boiling point. These zeotropic refrigerants typically have a significant glide characteristic, meaning that a large temperature difference exists between their lowest and highest boiling points. One example of these refrigerants is R-407C. In order to efficiently use zeotropic refrigerants, the inventors have found that the evaporator heat exchanger should be a true counterflow unit, wherein the flow of the water is in the opposite direction as the flow of the refrigerant. Conventional multiple pass evaporators, where one of the two fluids passes through tubing that switches back and forth, do not take advantage of the significant glide characteristics of zeotropic refrigerants. The counterflow configuration, on the other hand, maintains the greatest average temperature difference between refrigerant and fluid through the length of the heat exchanger, resulting in the greatest heat transfer, other variables being constant. In the preferred embodiment, the fluids flow in opposite directions, and each makes a single pass through the evaporator. As explained more fully below, the inventors found an efficient way to use a counterflow arrangement with zeotropic refrigerants, while still keeping the evaporator to commercially acceptable limits in length and overall design.

Figure 1:
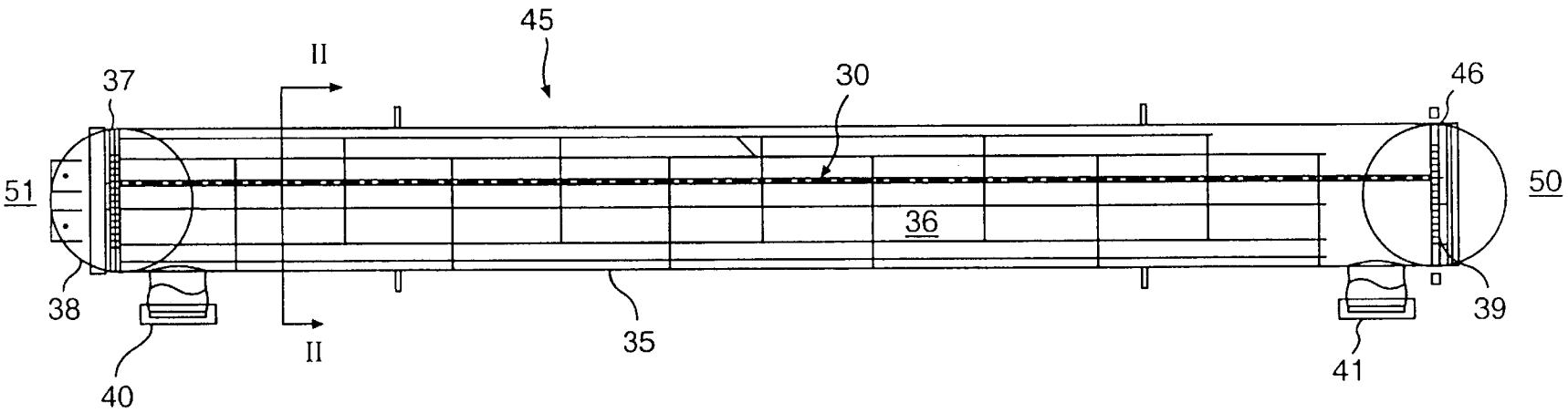
FIG. 1 is a side view showing an embodiment of an heat exchanger evaporator made according to the invention.
Figure 2:
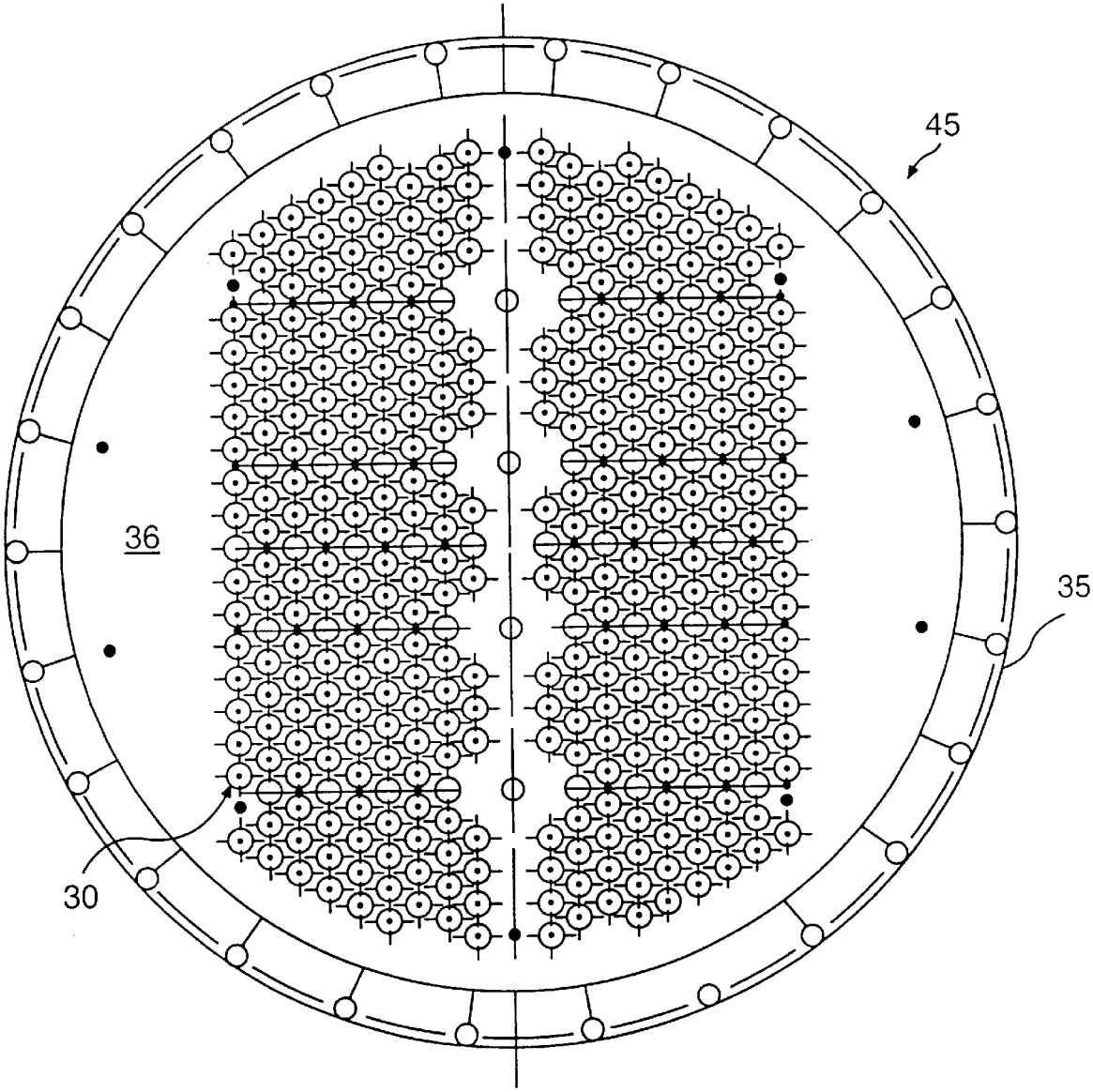
FIG. 2 is a cross sectional view, taken along line II—II, of the embodiment of the heat exchanger evaporator shown in FIG. 1.
Figure 3:
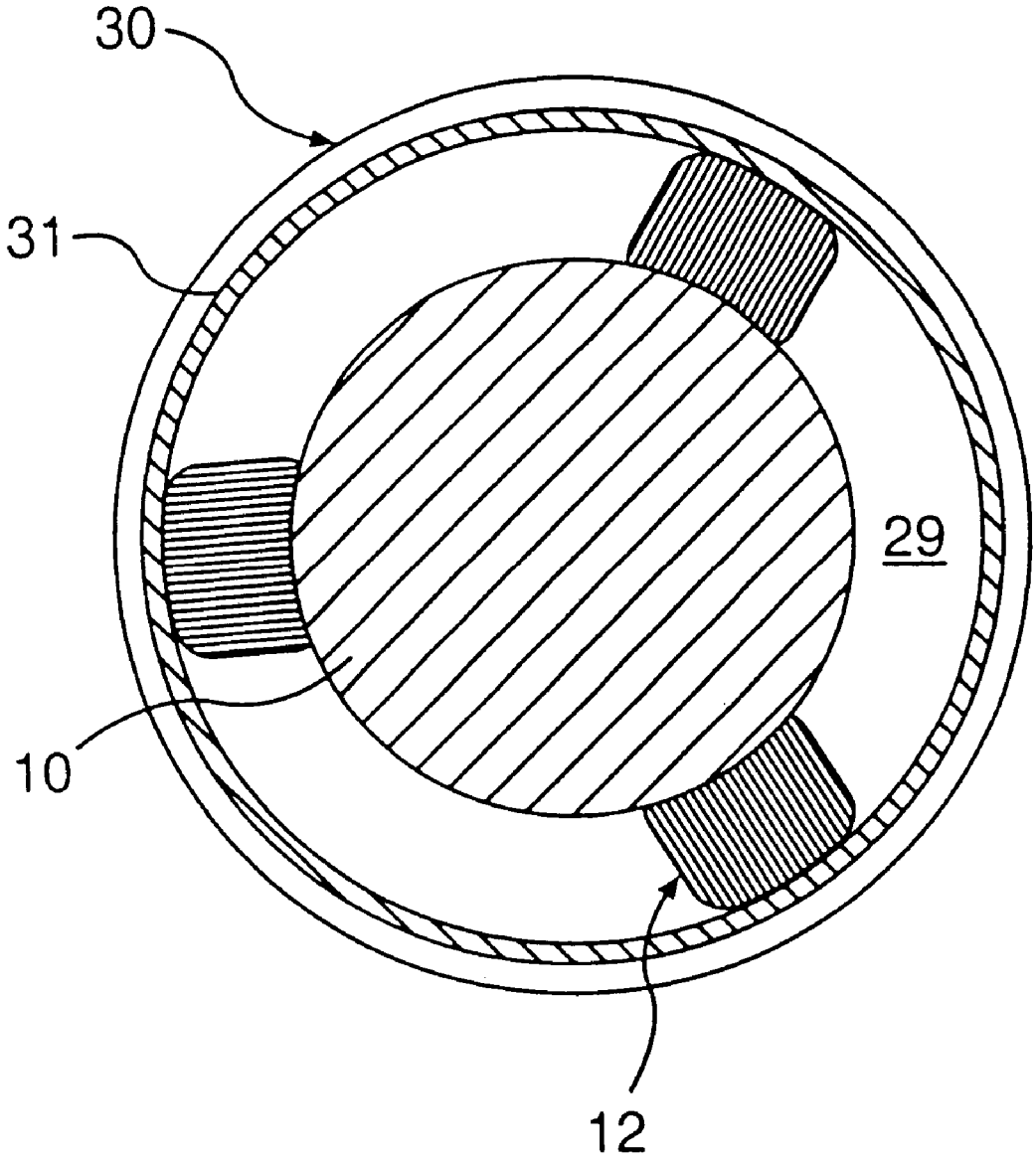
FIG. 3 is a cross sectional view of one of the tubular members of the evaporator of FIG. 1 showing an elongated inner member with resilient supports disposed within the elongated tubular member.

As shown in FIGS. 1–2, the invention comprises an evaporator 45 for transferring heat from a fluid to a zeotropic refrigerant having glide characteristics. The fluid is preferably water, but other fluids may also be used. For example, alcohol, brine, oil, and glycol can be used in the evaporator. The evaporator includes an elongated chamber 36 having headers 38, 39 at each end. A fluid inlet 40 is adjacent to a first end of the chamber for receiving fluid, such as water. The fluid flows in a first axial direction through the chamber 36 of the evaporator and is discharged in a cooled state through an outlet 41 adjacent an opposite second end of the chamber. The evaporator 45 also includes a refrigerant inlet 50 communicating with header 39 at one end of the chamber, and a refrigerant outlet 51 communicating with header 38 at the opposite end of the chamber. The evaporator further includes a plurality of elongated tubular members 30 positioned within the elongated chamber for receiving refrigerant from header 39 at the second end of the chamber, flowing the refrigerant through tubular members 30, and discharging the refrigerant in a heated state through header 38 and outlet 51, at the first end of the elongated chamber. In this arrangement, the evaporator is a true counterflow evaporator that accepts a single pass of refrigerant and fluid to be chilled, typically water. As will be described in more detail below, and as shown in FIG. 3, an extruded inner member 10 of elongated shape is disposed within each tubular member so that the inner member and the tubular member form an annulus 29 through which refrigerant flows, to facilitate heat transfer between the refrigerant and the other fluid.

Evaporator 45 has an elongated chamber 36 defined by an outer shell 35. In this embodiment the shell is of cylindrical shape, but the shell can be in a number of different shapes, without departing from the invention. Water enters the chamber 36 through the water inlet 40, travels through the chamber 36, and then exits at the outlet 41 in a cooled state. Liquid refrigerant is introduced at header 39 located at the second end of chamber 36, distributed through a liquid pass baffle 46 to the elongated tubular members 30, where the refrigerant flows in an opposite direction from the flow of the water. In the tubular members 30, the refrigerant absorbs heat from the water and evaporates. At the end of the chamber opposite to header 39, the tubular members 30 are connected to a suction pass baffle 37 where they communicate with a header 38, having an outlet for the refrigerant. At this outlet, the refrigerant exits the evaporator predominantly in a vapor state.

The bundle of heat exchanger tubes in the evaporator are held in position by a plurality of baffles spaced axially along the evaporator. These baffles have holes through which the tubular members fit. The end baffles at the ends of the evaporator have the same cross section as the evaporator, and with the outer shell define the refrigerant headers. The remaining baffles within the chamber do not extend across the entire chamber and are alternatively fixed to opposite inner surfaces of the evaporator, to direct the water flow in the evaporator in a wave like flow, to increase heat transfer between the water and the refrigerant flowing in the tubes. The evaporator achieves a counterflow of water and refrigerant, with both the refrigerant and the water flowing in only a single axial pass through the evaporator.

In the preferred embodiment, the elongated chamber, the plurality of elongated tubular members, and the elongated inner members are substantially straight. In this particular embodiment, the evaporator has a length of 12 feet, however, other lengths can be used to accommodate different flow rates and levels of heat exchange. Evaporator designs that have a length of 16 feet have given excellent results. As shown in FIG. 3, an elongated inner member 10 is disposed within the elongated tubular member 30. Both the inner member and the tubular member are dimensioned to form an annulus 29 between the opposing surfaces of the inner member and the tubular member. In the preferred embodiment, the inner member has a constant diameter. and thus, a uniform cross-section. A plurality of resilient support members 12, which preferably are tufts made of clusters of bristles, are attached to the inner member and are spaced along the length of the inner member so as to protrude to engage the tubular member and thereby centrally support the inner member within the tubular member. The best results have been obtained by supporting the inner member concentrically within the tubular member.

The refrigerant flows through the annulus 29 and transfers heat-through the wall of the tubular member 30 to a fluid flowing over the outer surface of the tubular member 30. In the preferred embodiment, the tubular member is circular in cross section and the inner member 10 has a solid circular cross-section, and is made of foamed plastic material. The dimensions of the annulus to be used will depend upon the particular application, considering the fluids used and the size and load characteristics of the evaporator. Annuli having a height (radial distance between the outer surface of the inner member 10 and the inner surface of the tubular member 30) within the range of ⅛ to ¼ inches have been shown to provide acceptable heat transfer for a tubular member of ⅝" inner diameter, although the invention is not limited to annuli only within this range.

The inner member 10 is made of a material that is compatible with the refrigerant flowing through the annulus and that does not otherwise impose practical or application problems. By means of example, an inner member 10 made of a foamed polymeric material has proven to be particularly good for zeotropic refrigerants such as R-407C. While the inner rods can be made of a variety of materials and still achieve many of the features of the present invention, solid synthetic rods having characteristics like those of polypropylene rods, and most preferably foamed polyethylene rods, have proven to be particularly well suited for the invention. Foamed polymeric rods are polymeric rods which have occluded pockets of gas. Foamed rods have greater strength and concentricity than solid polymer rods, and also have better rigidity and their dimensions can be better controlled during manufacturing. Such rods are also relatively inexpensive, as compared to rods made from other materials.

More specifically, inner members made of foamed polyethylene or of foamed polypropylene have given good results. Both of these materials resist chemical attack which would result in non-condensables. Other materials, including metals, can be used to form the inner members, but all have certain disadvantages such as excessive cost of formation or installation, corrosion, promotion of mechanical failures, excessive pressure drop, or difficulty of centering within the tubular members.

As shown in FIGS. 1 and 2, a plurality of tubular members are incorporated into an evaporator used to chill water. By means of example only, approximately 400 tubes have been included in an evaporator made according to the present invention. Each tubular member had a ⅝ in. inner diameter, and each inner member had a ⅜ in. outside diameter. These dimensional parameters may be modified as necessary for specific applications.

The evaporator of the present invention provides an increased efficiency of the refrigeration system due to increased heat exchanger efficiency between the refrigerant and water. The mass flow rate of the refrigerant near the surface of the tubular member is increased, resulting in increased heat transfer rate across the wall of the tubular member 30. The heat transfer rate can be further increased if the tubular member has a finned inner surface 31 in contact with the refrigerant, so that the effective inner surface area of the tubular member 30 is increased. Tubing having such finned inner surfaces are commercially available.

In the preferred embodiment, the inner member is held centrally within the tubular member by the resilient support members 12. In the embodiment illustrated in the drawings, the resilient support members extend from the inner member and are attached to the inner member at one end. At the opposite end the support members 12 engage the inner surface of the tubular member 30 and thereby maintain the inner member 10 in a substantially central position along the center line of the tubular member 30.

Figure 6:
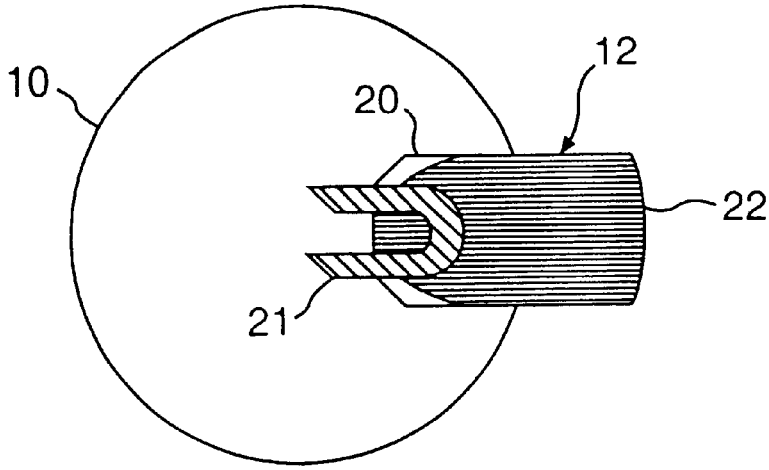
FIG. 6 is a cross sectional view along line VI—VI of the inner member shown in FIG. 4.

As shown in FIG. 6, in a preferred embodiment the resilient support members 12 are formed of tufts which in turn are preferably made of clusters of bristles 22 attached to the inner member 10. These tufts can be made of a variety of materials which are compatible with the refrigerant being used within the tubular member and which are sufficiently resilient to be readily inserted into a tube and yet hold the rod in position. By means of example, the tufts can be made of polypropylene bristles. Such tufts, or similar resilient members, can be fixed to the inner rod by a variety of conventional techniques. In the disclosed embodiment, the tufts are constructed by drilling or otherwise forming a hole 20 in the elongated inner member 10, and permanently affixing the tufts within the holes. In this embodiment, a cluster of bristles is doubled on itself and inserted in the hole 20. The doubled up cluster of bristles is then secured to the inner member by a staple 21 made of steel, or other suitable material. The bristles extending from the surface of the inner member are then trimmed to the proper length, such that the inner member and resilient tufts can easily be inserted into the tubular member and the tufts will then press fit against the inner wall of the tubular member. As an example, an inner member of ⅜ in. diameter is drilled to form a hole 0.125 in. deep and 0.125 in. in diameter, to accommodate a tuft of 0.100 in. diameter. Bristles with a diameter of 0.010 inches have been acceptable in this application.

Ultimately, the support members of the present invention can be made of a variety of materials and techniques, as long as the resultant support members hold the outer and inner members in proper position, in a manner that is both economical and technically acceptable.

One advantage of forming the resilient support members 12 from bristles made into tufts, is that the support members will bend but then return by themselves to their original shape, resulting in easy insertion of the elongated inner member 10 into the elongated tubular member 30 through one open end of the tubular member. Once the elongated inner member 10 is inserted in the tubular member 30, the resilient supports 12 center the elongated inner member 10 and maintain it in its proper position within the elongated tubular member 30 to form the annulus 29.

In the present preferred embodiment, the resilient support members are spaced along the length of the inner member, and are also spaced around the perimeter of the annulus. As embodied herein and referring to FIGS. 4 and 5, the resilient support members 12 are located around the periphery of inner member 10 and are separated by equidistant angular spaces. In this case, sets of three support members are placed around the circumference of the inner member 10, and are separated by 120° of arc. Additionally, the support members 12 of a set are spaced axially along the inner member 10, preferably by equal axial distances.

Figure 4:
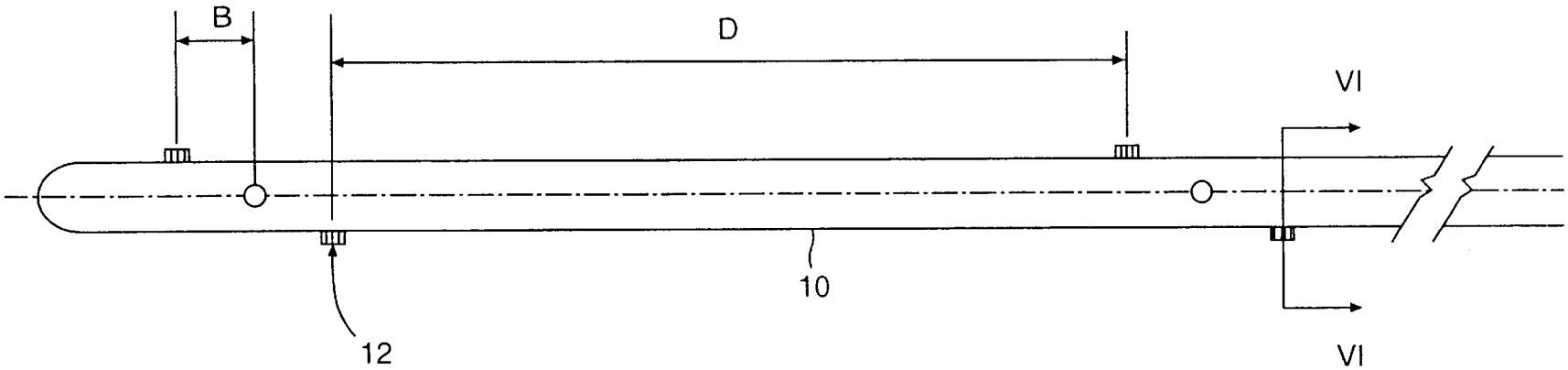
FIG. 4 is a side view of one embodiment of the elongated inner member with resilient support members.
Figure 5:
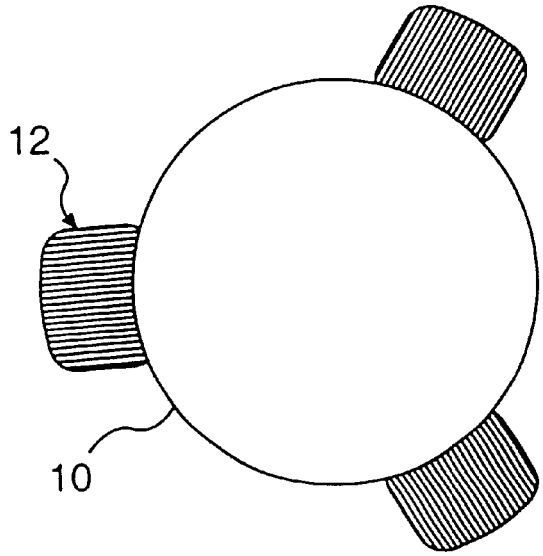
FIG. 5 is an end view of the elongated inner member of FIG. 4.

In a preferred embodiment, several sets made up of three tufts each are placed at specific distances along the inner member, so that the inner member 10 is supported substantially centrally within the tubular member 30 along its entire length. Within each set of support members, the individual tufts are equidistant around the circumference of the inner member as well as along the axial length of the inner member. Additionally, the support members of at least one of the sets define a spiral path along the length of the annulus 29, as shown in FIG. 4.

The preferred configuration of the support members minimizes the amount of pressure drop that is incurred by the refrigerant flowing through the annulus 29.

Pressure drops between three and seven psi are generally acceptable for the refrigerant flowing in the annular passage, without reducing the efficiency of the refrigeration system. For the specific, exemplary tube and rod dimensions discussed above, these pressure losses correspond to a gap frequency between the sets of resilient support members of about ten inches and three inches, respectively. More specifically, a distance of 6.625 inches between successive sets of resilient supports has been found acceptable, as shown by distance "D" in FIG. 4. The spacing of the individual tufts within each set of support members can also be optimized to reduce the pressure drop, while still centering the elongated inner member 10. For example, an axial spacing of approximately 0.5 inch from one tuft to the next has been found acceptable, and is indicated by distance "B" in FIG. 4.

The spiral configuration of the supports 12 used in the preferred embodiment also imparts a spiral motion to the refrigerant. This tends to minimize stratification of the refrigerant into liquid layers and vapor layers, as the refrigerant changes phase from a liquid to a gas through the tubular member, due to the heat absorbed from the fluid.

The evaporator of the present invention is preferably used with a zeotropic refrigerant having significant glide characteristics. One such refrigerant is R-407C, which is a ternary blend of HFC-32/HFC-125/and HFC-134a, and is a non-ozone depleting refrigerant. This blend has several boiling and condensation temperatures, at a given pressure. The range over which the boiling/condensation temperature varies is referred to as temperature glide. A number of other zeotropic refrigerants can also be used in the application of the invention.

As is evident from the above description, the present invention includes a method for effectuating an exchange of heat between a fluid and a refrigerant in a tube and shell heat exchanger with an elongated chamber. The steps include flowing the refrigerant through an annular passage formed between the opposing surfaces of an elongated tubular member and an elongated inner member disposed within the tubular member, the tubular member being in turn disposed within the elongated chamber. A further step is flowing the fluid around the outer surface of the tubular member. In this method, the inner member is supported within the tubular member by a plurality of resilient supports spaced along the length of the inner member, protruding from the inner member, and engaging the tubular member.

A preferred embodiment of a method for cooling a fluid in a shell and tube type evaporator, according to the invention, includes the steps of flowing a fluid, such as water, into the evaporator through a fluid inlet disposed adjacent to a first end of the shell of the evaporator, flowing the fluid through an elongated chamber within the shell in a first axial direction, and discharging the fluid from the heat exchanger through a fluid outlet disposed adjacent to a second end of the shell opposite to the first end. The method further includes the steps of flowing the refrigerant through a refrigerant inlet into a first header placed at the second end of the shell, flowing the refrigerant in the second direction opposite to the first direction through an annulus formed between opposing surfaces of a tubular member within the elongated chamber and an inner member within the tubular member, and discharging the refrigerant from a second header at the first end of the shell opposite to the first header, through a refrigerant outlet. Both the refrigerant and the fluid flow through the evaporator only once, and preferably the refrigerant is a zeotropic refrigerant with significant glide characteristics. The evaporator has a plurality of outer tubes and inner members, according to the present invention, each having a length in the order of 16 feet. The specific dimensions of the device may vary depending on the amount and temperature of the fluid cooled.

The method of cooling water using a refrigerant flowing in a direction opposite to the water, wherein elongated inner members supported by tufts are disposed within the elongated tubular members, is especially advantageous where a zeotropic refrigerant having glide characteristics is employed as the working refrigerant. This method allows for an improved system efficiency for the refrigeration cycle and also allows for the use of a shorter evaporator, without sacrificing efficiency. The inserts so constructed are easy to install and do not promote galvanic corrosion.

Figure 7:
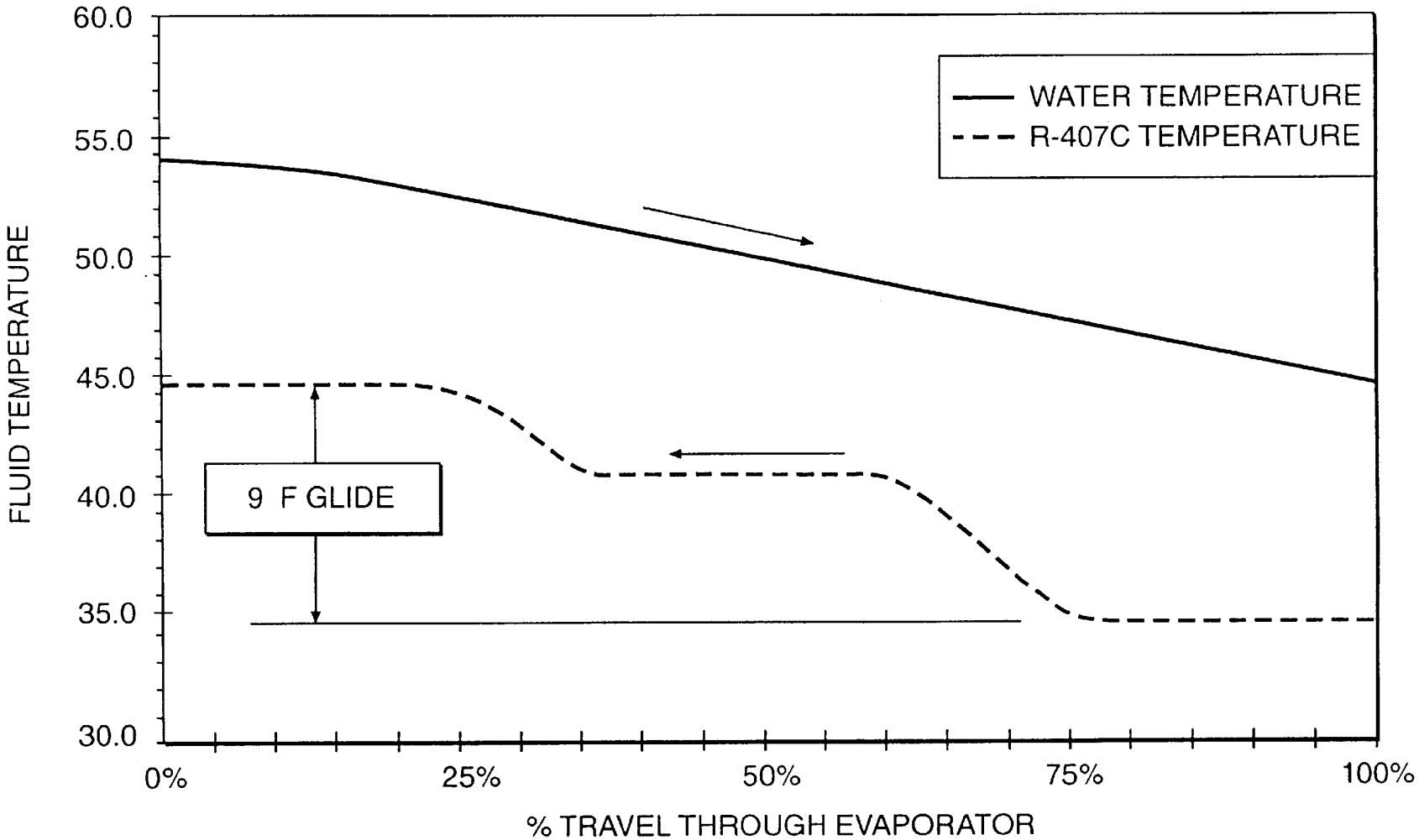
FIG. 7 is a diagram illustrating an example of the temperature of water and refrigerant as they flow through an evaporator made according to the present invention.

The invention thus provides a counterflow evaporator for an air cooled chiller refrigeration system that uses a significant glide zeotropic refrigerant such as R-407C. The evaporator and tubing are sufficiently long to evaporate the refrigerant from a predominately liquid state upon entering into the inlet of the evaporator, to a gas of approximately 95% quality upon exiting. For an evaporator having 382 tubes of ⅝ inch outside diameter and inner cylindrical members having a diameter of ⅜ inch, lengths of 16 feet have been shown to provide the desired efficiency. It is believed that evaporators of the present invention with lengths of twelve feet or more will provide marked benefits over prior systems. FIG. 7 shows a diagram of the temperature of water and of R-407C refrigerant as they flow in opposite directions through an evaporator constructed according to the present invention.

The preferred embodiment of the inner members is low in cost because the inner members are made of polymeric rods and can be fitted with support members that hold the members in place by an economic and easy to assemble support system. One such embodiment is the foamed polyethylene rod with tuft supports disclosed in detail above. The production and materials costs for this embodiment are low relative to metal rods, and the assembly of the inner member into the tubular members is extremely easy and cost effective. The resultant combination has also proven to be completely noise free, relative to other options. The use of the polypropylene or polyethylene rod and tufts also should be non-deleterious to the outer tube from the standpoint of galvanic corrosion or tube leakage caused by metal-to-metal interface. Furthermore, this combination of elements provides high heat exchange values with low or moderate pressure drops. Other tube materials and support features that provide the same or similar beneficial properties fall within the scope of the invention, defined by the claims.

It will be apparent to those skilled in the art that various modifications and variations can be made in the structure and the methodology of the present invention without departing from the spirit or scope of the invention. Thus, it is intended that the present invention cover the modifications and variations of this invention provided they come within the scope of the appended claims and their equivalents.

What we claim is:

1. A heat exchanger for transferring heat between a fluid flowing over an outer surface of a tubular member and a refrigerant flowing through the tubular member, said heat exchanger comprising:

an elongated inner member having a uniform cross-section disposed within the elongated tubular member, said elongated inner and tubular members being dimensioned to form an annulus between opposing surfaces of the inner and tubular members to facilitate heat transfer between a fluid flowing in the annulus and a fluid flowing over the tubular member; and a plurality of resilient support members in the form of tufts of bristles attached to the inner member, spaced along the length of the inner member, and having a press fit engagement against an inner surface of the elongated tubular member, said support members configured to hold the inner member in position within the tubular member.

2. The heat exchanger of claim 1, wherein said tubular member and said inner member are substantially straight and are concentric.

3. The heat exchanger of claim 1, wherein said tubular member and said inner member have a length of at least 12 feet.

4. The heat exchanger of claim 1, wherein the inner member and the support member are chemically compatible with the refrigerant.

5. The heat exchanger of claim 4, wherein the inner member and the support member are chemically compatible with a zeotropic refrigerant.

6. The heat exchanger of claim 1, wherein the inner member is made of a polymeric material.

7. The heat exchanger of claim 6, wherein the polymeric material includes polyethylene.

8. The heat exchanger of claim 7, wherein the inner member is made of foamed polyethylene.

9. The heat exchanger of claim 1, wherein the annulus is for containing the refrigerant flowing through the tubular member.

10. The heat exchanger of claim 9, wherein the inner member has a circular cross-section.

11. The heat exchanger of claim 10, wherein a ratio of a diameter of the inner member to a diameter of the tubular member ranges from approximately 3/5 to approximately 4/5.

12. The heat exchanger of claim 1, wherein the bristles are between about 0.100 inch and about 0.010 inch in diameter.

13. The heat exchanger of claim 1, wherein the tufts of bristles are formed of a non-thermally conductive material.

14. An evaporator for transferring heat from a fluid to a refrigerant, said evaporator comprising:

an elongated chamber having headers at each end and a fluid inlet adjacent a first end of the chamber for receiving the fluid at a first end of the chamber, flowing the fluid in a first axial direction through the chamber, and discharging the fluid in a cooled state through an outlet adjacent the opposite second end of the chamber;

a refrigerant inlet communicating with the header at the second end of the chamber and a refrigerant outlet communicating with the header at the opposite first end of the chamber;

a plurality of elongated tubular members positioned within said elongated chamber for receiving refrigerant from the header at the second end of the chamber, flowing the refrigerant through the tubular member, and discharging the refrigerant in a heated state through the header and outlet at the first end, whereby the evaporator is a counterflow evaporator;

elongated inner members disposed within the at least some of said tubular members, said inner and tubular members being dimensioned to form an annulus between opposing surfaces of the inner and tubular member to facilitate heat transfer between the refrigerant and the fluid; and a plurality of resilient support members spaced along the length of each inner member, and having a press fit engagement against an inner surface of the respective elongated tubular member, said support members configured to hold the inner member in position within the tubular member, wherein the resilient support members are tufts attached to the inner member.

15. The evaporator of claim 14, wherein a ratio of a diameter of each inner member to a diameter of each tubular member ranges from approximately 3/5 to approximately 4/5.

16. The evaporator of claim 14, wherein said tubular members and said inner members are substantially straight.

17. The evaporator of claim 14, wherein said tubular and inner members are concentric.

18. The evaporator of claim 14, wherein the resilient support members support the inner member substantially centrally within the tubular member.

19. The evaporator of claim 14, wherein said support members are formed in a plurality of sets, with each set including a plurality of support members spaced around the perimeter of the annulus and positioned at a different axial position along the annulus.

20. The evaporator of claim 19, wherein the support members of at least one set are positioned equidistant around the perimeter of the annulus.

21. The evaporator of claim 19, wherein the support members of at least one set define a spiral along the length of the annulus.

22. The evaporator of claim 19, wherein each support set includes three support members.

23. The evaporator of claim 14, wherein each inner member is a solid member.

24. The evaporator of claim 14, wherein each inner member is made of a material selected from the group of foamed or solid polypropylene and polyethylene.

25. The evaporator of claim 14, wherein the support members of a set are spaced about 0.5 inch from each other along the length of the inner member.

26. The evaporator of claim 14, wherein the tufts are made of a cluster of bristles.

27. The evaporator of claim 26, wherein the bristles are between about 0.100 inch and about 0.010 inch in diameter.

28. The evaporator of claim 18, wherein each of the tubular members is a metal tube.

29. The evaporator of claim 28, wherein each of the tubular members has a finned inner surface to increase heat transfer with the fluid flowing in the annulus.

30. The evaporator of claim 14, wherein the tubular members and the inner members have a length of at least 12 feet.

31. The evaporator of claim 14, wherein the refrigerant is a zeotropic refrigerant.

32. The evaporator of claim 18, wherein the inner members are made of a polymeric material.

33. The evaporator of claim 32, wherein the polymeric material includes polyethylene.

34. The evaporator of claim 14, wherein the annulus is for containing the refrigerant flowing through the tube.

35. The evaporator of claim 14, wherein the tufts are formed of a non-thermally conductive material.

36. An evaporator for transferring heat from a fluid to a refrigerant, said evaporator comprising:

an elongated chamber having headers at each end and a fluid inlet adjacent a first end of the chamber for receiving the fluid at a first end of the chamber, flowing the fluid in a first axial direction through the chamber, and discharging the fluid in a cooled state through an outlet adjacent the opposite second end of the chamber;

a refrigerant inlet communicating with the header at the second end of the chamber and a refrigerant outlet communicating with the header at the opposite first end of the chamber;

a plurality of elongated tubular members positioned within said elongated chamber for receiving refrigerant from the header at the second end of the chamber, flowing the refrigerant through the tubular member, and discharging the refrigerant in a heated state through the header and outlet at the first end, whereby the evaporator is a counterflow evaporator;

elongated inner members disposed within at least some of said tubular members, said inner and tubular members being dimensioned to form an annulus between opposing surfaces of the inner and tubular member to facilitate heat transfer between the refrigerant and the fluid; and a plurality of resilient support members spaced along the length of each inner member, and having a press fit engagement against an inner surface of the respective elongated tubular member, said support members configured to hold the inner member in position within the tubular member, wherein said support members are formed in a plurality of sets, with each set including a plurality of support members spaced around the perimeter of the annulus and positioned at a different axial position along the annulus, and wherein the support members of a set are spaced about 0.5 inch from each other along the length of the inner member.

37. A method for exchanging heat between a fluid and a refrigerant in a tube and shell heat exchanger, comprising the steps of:

flowing the refrigerant through an annular passage formed by an annulus defined by the opposing surfaces of an elongated tubular member and an elongated inner member having a uniform cross section disposed within the tubular member, said tubular member being disposed within the shell of the heat exchanger;

flowing the fluid around the outer surface of the tubular member; and holding the inner member in position within the tubular member by engaging a plurality of resilient supports in the form of tufts with an inner surface of the tubular member so as to press fit the supports against the inner surface, said resilient supports being spaced along the length of the inner member and protruding from the inner member.

38. The method of claim 37, wherein the resilient supports are attached at one end to the inner member and engage at the other end the surface of the tubular member.

39. The method of claim 38, wherein the inner member has a constant diameter.

40. The method of claim 37, wherein the inner member is solid and has a circular cross section.

41. The method of claim 37, wherein the inner member is made of polypropylene.

42. The method of claim 37, wherein the tufts are made of a cluster of bristles.

43. The method of claim 37, wherein the resilient supports are formed in a plurality of sets, with each set including a plurality of resilient supports spaced around the perimeter of the annulus and positioned at a different axial position along the annulus.

44. The method of claim 43, wherein the resilient supports of at least one set are equidistant around the perimeter of the annulus, and define a spiral along the length of the annulus.

45. The method of claim 37, wherein the refrigerant is a zeotropic refrigerant and the inner member and the resilient support members are chemically compatible with a zeotropic refrigerant.

46. The method of claim 37, wherein the inner member and the tubular member are substantially straight and are concentric.

47. The method of claim 37, wherein the inner member is made of a polymeric material.

48. The method of claim 47, wherein the inner member is solid.

49. The method of claim 47, wherein the polymeric material includes polyethylene.

50. The method of claim 37, wherein a ratio of a diameter of the inner member to a diameter of the tubular member ranges from approximately ⅗ to approximately ⅘.

51. A method for exchanging heat between a fluid and a refrigerant in a tube and shell heat exchanger, comprising the steps of:

flowing the refrigerant through an annular passage formed by an annulus defined by the opposing surfaces of an elongated tubular member and an elongated inner member having a uniform cross section disposed within the tubular member, said tubular member being disposed within the shell of the heat exchanger;

flowing the fluid around the outer surface of the tubular member; and holding the inner member in position within the tubular member by engaging a plurality of resilient supports in the form of bristles with an inner surface of the tubular member so as to press fit the supports against the inner surface, said resilient supports being spaced along the length of the inner member and protruding from the inner member, the resilient supports being formed in a plurality of sets, with each set including a plurality of resilient supports spaced around the perimeter of the annulus and positioned at a different axial position along the annulus, wherein the resilient supports of a set are spaced about 0.5 inch from each other along the length of the inner member.

52. A method for cooling a fluid by evaporating a refrigerant in a shell and tube type evaporator, comprising the steps of:

flowing the fluid into the evaporator through a fluid inlet disposed adjacent to a first end of the shell of the evaporator, flowing the fluid through the shell in a first axial direction, and discharging the fluid through a fluid outlet disposed adjacent to a second end of the shell opposite to the first end;

flowing the refrigerant through a refrigerant inlet into a first header at the second end of the shell, flowing the refrigerant in a second direction opposite to the first direction through at least one annulus formed between opposing surfaces of a tubular member disposed within the shell and an inner member disposed within the tubular member, and discharging the refrigerant out of a second header at the first end of the shell opposite to the first header, through a refrigerant outlet; and holding the inner member in position within the tubular member by engaging a plurality of resilient supports in the form of tufts with an inner surface of the tubular member so as to press fit the resilient supports against the inner surface, said resilient supports being spaced along the length of the inner member and protruding from the inner member.

53. The method of claim 52, wherein the refrigerant is a zeotropic refrigerant.

54. The method of claim 52, wherein the refrigerant and the fluid both flow through the heat exchanger in a single pass.

55. The method of claim 54, wherein refrigerant is flowed through a plurality of annuli formed between respective opposing surfaces of a plurality of tubular members and corresponding inner members held within the shell of the evaporator and wherein each tubular member and corresponding inner member are concentric.

56. The method of claim 52, wherein the resilient support members support the inner member substantially centrally within the tubular member.

57. The method of claim 52, wherein the tufts are made of clusters of bristles attached to the inner member.

58. The method of claim 52, wherein the inner member is solid and is made of foamed polypropylene.

59. The method of claim 58, wherein at least two of the support members are spaced about 0.5 inch from each other along the length of the inner member.

60. The method of claim 52, wherein the refrigerant is flowed through a plurality of annuli formed between respective opposing surfaces of a plurality of tubular members disposed within the shell and a plurality of corresponding inner members disposed within the tubular members.

61. The method of claim 60, wherein the refrigerant is a zeotropic refrigerant.

62. The method of claim 52, wherein the inner member is made of a polymeric material.

63. The method of claim 62, wherein the inner member is solid.

64. The method of claim 62, wherein the polymeric material includes polyethylene.

* * * * *

UNITED STATES PATENT AND TRADEMARK OFFICE

CERTIFICATE OF CORRECTION

PATENT NO. : 6,530,421 B1 
DATED : March 11, 2003
INVENTOR(S) : Ronald Henry Filius and Stephen Harold Smith It is certified that error appears in the above-identified patent and that said Letters Patent is hereby corrected as shown below:

Column 9,
Line 47, "claim 9," should read -- claim 1. --.

Column 10,
Lines 56 and 66, "claim 18," should read -- claim 14, --.

Signed and Sealed this

Fifteenth Day of July, 2003

JAMES E. ROGAN
*Director of the United States Patent and Trademark Office*